United States Patent [19]

Debski

[11] 4,039,975

[45] Aug. 2, 1977

[54] E PLANE FOLDED HYBRID WITH COAXIAL DIFFERENCE PORT

[75] Inventor: Thomas R. Debski, Bethpage, N.Y.

[73] Assignee: Sedco Systems, Incorporated, Melville, N.Y.

[21] Appl. No.: 676,386

[22] Filed: Apr. 12, 1976

[51] Int. Cl.[2] ..... H01P 5/20

[52] U.S. Cl. ..... 333/11; 333/21 R; 333/35

[58] Field of Search ..... 333/11

[56] References Cited

U.S. PATENT DOCUMENTS

| | | | |
|---|---|---|---|
| 2,840,787 | 6/1958 | Adcock et al. | 333/11 |
| 2,853,683 | 9/1958 | Murphy | 333/11 |
| 3,311,851 | 3/1967 | Abrams | 333/11 |
| 3,629,734 | 12/1971 | Siekanowicz et al. | 333/11 |
| 3,737,812 | 6/1973 | Gaudio et al. | 333/32 |

*Primary Examiner*—Paul L. Gensler
*Attorney, Agent, or Firm*—Brumbaugh, Graves, Donohue & Raymond

[57] ABSTRACT

An E plane folded hybrid for use in waveguide circuits has a coaxial difference port. The hybrid design is particlarly useful for applications using half-height or ridge waveguide wherein the junction region of the hybrid is of insufficient size to provide a waveguide difference port.

6 Claims, 9 Drawing Figures

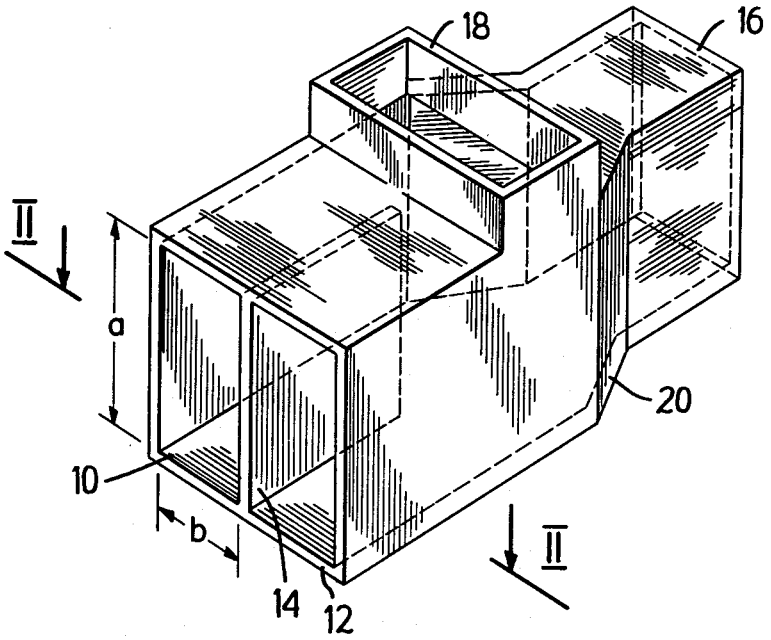
FIG. 1
(PRIOR ART)
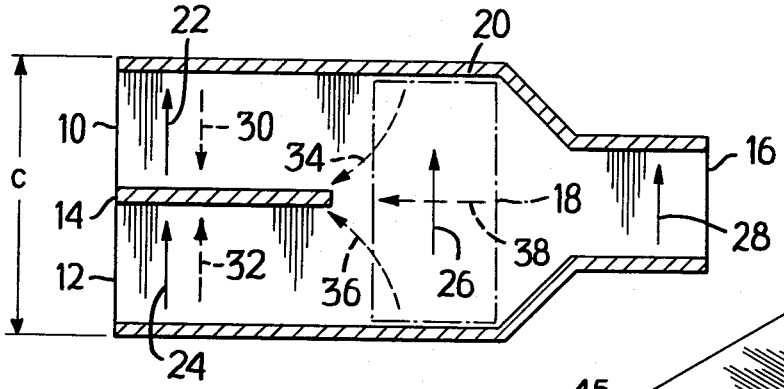
FIG. 2
(PRIOR ART)
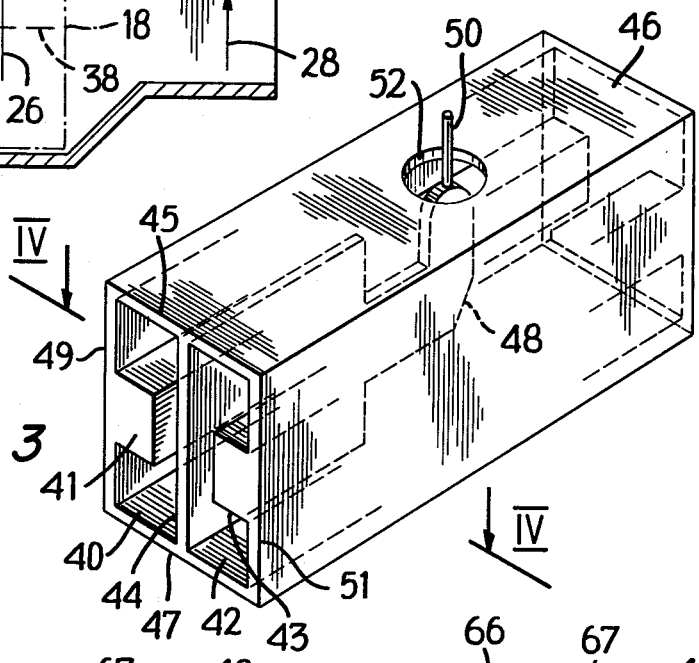
FIG. 3
FIG. 4
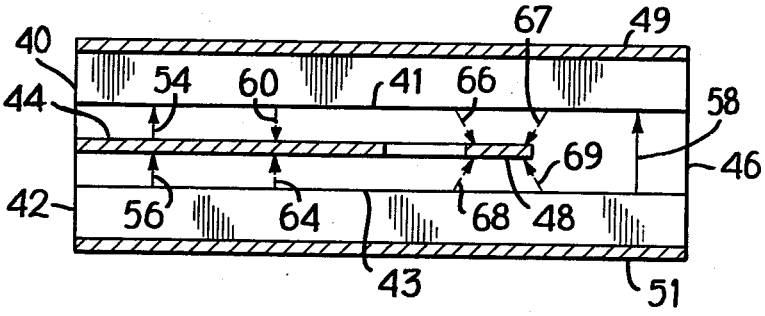
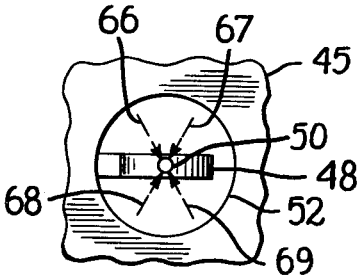
FIG. 5

E PLANE FOLDED HYBRID WITH COAXIAL DIFFERENCE PORT

BACKGROUND OF THE INVENTION

This invention relates to waveguide hybrid power dividers and in particular to folded hybrids.

Waveguide hybrids are commonly used in various microwave circuits, such as monopulse comparators, feed networks for antennas, waveguide switches and waveguide circulators. The most commonly known waveguide hybrid is the "magic tee", which provides colinear output waveguide ports which are opposite facing with respect to each other. There have been previously developed waveguide hybrids, using rectangular waveguide, which are "folded" in the E plane or H plane so that the colinear output ports are adjacent to each other in the E plane or the H plane.

FIG. 1 shows a typical prior art E plane folded hybrid. The hybrid has colinear output ports 10 and 12 which are adjacent to each other in the E plane, having a common H plane wall formed by a bifurcating member 14. Opposite the colinear output ports is a sum port 16, also of rectangular waveguide. Between sum port 16 and colinear output ports 10 and 12 there is a junction region 20. A difference port 18, also of rectangular waveguide is formed on the E plane wall of junction region 20.

The operation of the prior art E plane folded hybrid is illustrated in FIG. 2. In-phase wave energy signals supplied at colinear ports 10 and 12 are illustrated by solid arrows 22 and 24. When these signals reach junction region 20, where septum 14 terminates, the phase characteristics of the signals cause there to be substantially no discontinuity and there is formed a single wave energy signal represented by solid arrow 26 in junction region 20 which is transmitted past the tapered section to form an output signal 28 at sum port 16. Since the device is reciprocal in nature a wave energy signal supplied at sum port 16 will produce in-phase output signals 22 and 24 at colinear output ports 10 and 12.

Dotted arrows 30 and 32 represent out-of-phase signals supplied to colinear ports 10 and 12. Upon arriving at the end of bifurcation 14 these signals encounter a discontinuity indicated by curved dotted arrows 34 and 36 which tend to move in circular fashion within junction region 20 to form an output signal 38 in difference port 18. Difference port 18 is also reciprocal in nature and wave energy signals supplied to this port will cause there to be output signals in phase opposition illustrated by arrows 30 and 32 at colinear ports 10 and 12.

Another characteristic of the hybrid illustrated in FIGS. 1 and 2 is that colinear ports 10 and 12 are mutually isolated, as are sum and difference ports 16 and 18.

The hybrid illustrated in FIGS. 1 and 2 are typically produced using standard rectangular waveguides wherein the ratio of the H plane dimension $a$ to the E plane dimension $b$ is approximately 2 to 1. Consequently the combined E plane dimensions of the adjacent colinear arms $c$ is sufficient to permit propagation of the fundamental waveguide mode in junction region 20 and difference port 18. In cases wherein the waveguide is either under-height waveguide, having a reduced $b$ dimension, or ridge waveguide, having reduced $a$ and $b$ dimensions, the physical size of the junction region 20 may be physically insufficient to support the propagation of the difference mode through the junction region. While a waveguide difference port, such as difference port 18 in FIG. 1, may itself be ridge loaded to improve propagation characteristics, it is difficult to provide such ridge loading for the junction region 20 without disruption of the propagation of signals from port 16 to colinear ports 10 and 12.

It is therefore an object of the present invention to provide an E plane folded hybrid usable with waveguide having reduced cross section dimensions.

It is a further object of the invention to provide such a folded hybrid usable with ridge loaded waveguide.

SUMMARY OF THE INVENTION

In accordance with the present invention there is provided an E plane folded hybrid which comprises a waveguide, having an input port, an E plane, and an H plane. There is provided an H plane bifurcation in the waveguide forming first and second colinear waveguides communicating with first and second colinear output ports. A coaxial difference port is formed in the wall of the input waveguide, adjacent to the bifurcation and having an outer conductor connected to the waveguide and an inner conductor connected to the bifurcation.

In a preferred embodiment of the invention the inner conductor of the difference port is connected to the bifurcation by an L shaped septum which is substantially in the plane of the bifurcation. The invention may be used to advantage with rectangular waveguides including ridge loaded rectangular waveguides. In a further embodiment of the invention the sum port and the colinear output ports are double ridge waveguide. The bifurcation in this embodiment includes a tapered ridge. A transformer may be included in the input waveguide so that all waveguide ports have the identical double ridge loaded cross section. In cases where it is desired that the difference port also be ridge loaded waveguide, a coaxial-to-waveguide transition may be supplied at this port.

For a better understanding of the present invention, together with other and further objects thereof, reference is had to the following description, taken in conjunction with the accompanying drawings, and its scope will be pointed out in the appended claims.

BRIEF DESCRIPTION OF THE DRAWINGS

FIG. 1 is a perspective view of a prior art E plane folded hybrid.

FIG. 2 is a cross sectional view of the FIG. 1 folded hybrid.

FIG. 3 is a perspective view of a hybrid in accordance with the present invention.

FIG. 4 is a cross sectional view of the FIG. 3 hybrid indicating the polarity of the electric fields.

FIG. 5 is a partial view of the FIG. 3 hybrid showing the fields in the region of the coaxial difference port.

DESCRIPTION OF THE INVENTION

Figure 8:
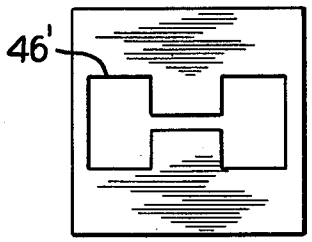
FIG. 8 is another end view of the hybrid shown in FIGS. 6 and 7.

A simplified embodiment of a hybrid in accordance with the present invention is shown in FIGS. 3, 4 and 5. The hybrid is formed from a double ridge waveguide with an input port 46. The double ridge waveguide has ridges 41 and 43 located on H plane walls 49 and 51. Within the ridge waveguide there is a bifurcating partition 44 which extends between the E plane walls 45 and 47. The bifurcation divides the double ridge waveguide into two single ridge waveguides having openings 40 and 42 which form the colinear ports of the hybrid.

Bifurcation 44 has an extension, comprising L shaped septum 48, which is connected to center conductor 50 which forms a part of coaxial difference port whose outer conductor 52 is connected to E plane wall 45 of the double ridge waveguide. Septum 48 is relatively small in wavelengths. Typically the distance between center conductor 50 and the end of bifurcation 44 along the waveguide axis is only about one-tenth of a wavelength.

FIG. 4 is a cross sectional view of the hybrid shown in FIG. 3 indicating the electric field of signals in the hybrid. The operation of the hybrid in the sum mode is similar to that of the prior art hybrid. In-phase signals represented by arrows 54 and 56, which are supplied to colinear ports 40 and 42, form an output signal 58 at sum port 46. Signals supplied at sum port 46 are similarly divided into in-phase signals at colinear ports 40 and 42. Out-of-phase signals represented by dotted arrows 60 and 64 propagate in the TEM mode along septum 48, form symmetrical fields 66, 67, 68 and 69 where the septum bends and combine to form a TEM mode signal in the difference port formed by inner conductor 50 and outer conductor 52, as further illustrated in FIG. 5. The difference port is also reciprocal and signals supplied to the coaxial difference port will form out-of-phase signals at colinear ports 40 and 42.

Figure 7:
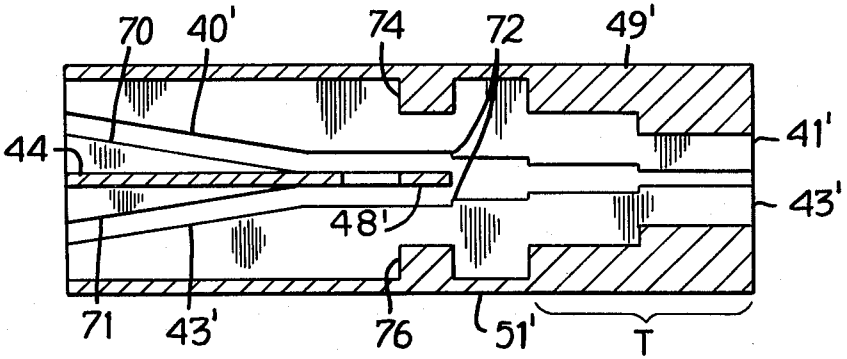
FIG. 7 is a cross sectional view of the FIG. 6 hybrid.
Figure 6:
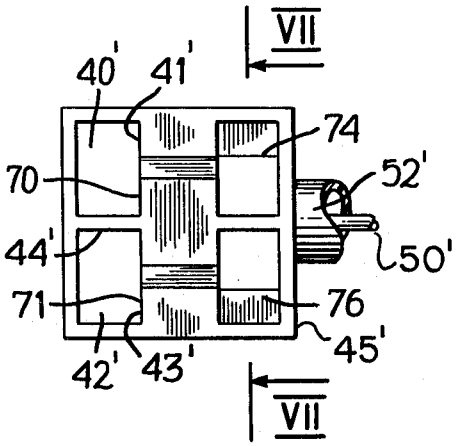
FIG. 6 is an end view of another hybrid in accordance with the present invention.

Those familiar with the equations which govern four port reciprocal networks will recognize that in order to form a true hybrid junction, where the colinear ports are mutually isolated and the sum and difference ports are mutually isolated, it is necessary to provide impedance matching of the sum and difference ports. In addition to impedance matching these ports it is desirable in many applications to have input and colinear output ports of the hybrid with the same waveguide cross section. This is particularly desirable in applications where a series of such hybrids may be used for processing supplied signals. FIGS. 6 through 8 show an embodiment of the present invention which is complete with impedance matching structures and has identical sum and colinear ports. The sum port 46' of this embodiment which is shown in FIGS. 7 and 8 has a selected double ridge waveguide cross section. There is provided between the sum port and the section of waveguide wherein the bifurcation occurs, a transformer section, indicated by T, wherein the waveguide input is transformed in impedance by one or more quarter-wave transformer sections. In addition output ports 40' and 42' have the same double ridge waveguide cross section as sum port 46'. The ridges 41', 43', 70 and 71 of colinear output ports 40' and 42' are tapered so that in region of the start of bifurcation 44' each of the colinear waveguides has only a single ridge. In order to improve the impedance match of the section in which the bifurcation and L shaped septum are placed there are included steps 72 in ridges 41' and 43', which compensate for the presence of septum 48' between the ridges. There are additionally provided ridges 74 and 76, located on the H plane walls of the bifurcated waveguide and transverse to ridges 41' and 43', which tend to lower the impedance of the transmission line formed by L shaped septum 48' and the H plane walls 49' and 51' of the double ridge waveguide.

While the arrangements illustrated in FIGS. 6, 7 and 8 are useful methods of providing impedance match of the hybrid, particularly where there are identical sum and colinear ports, those skilled in microwave circuits recognize that other structures may be used for impedance matching. The hybrid of FIGS. 6 through 8, since it is formed of broadband ridge waveguide and coaxial elements, and since its junction region is small in wavelengths, is inherently broadband. Typically is is possible to achieve good performance over bandwidths of up to 2 to 1.

Figure 9:
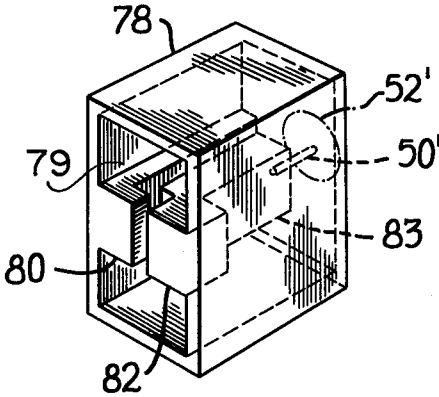
FIG. 9 is a coaxial to ridge waveguide transition usable with the hybrids of FIGS. 3 to 8.

Shown in FIG. 9 is a structure useful when it is desired that the coaxial difference port of the hybrid shown in FIGS. 3 through 8 be converted to ridge waveguide. Shown in FIG. 9 is a section 78 of ridge waveguide. Section 78 has an opening 79 at one end which may be mounted in a flange for connection to additional sections of double ridge waveguide or other circuits. Ridge 80 runs along one H plane wall of section 78 and is stepped to accommodate the shape of ridge 82. Ridge 82 is connected to its adjacent H plane wall over only a portion of its length and has a section 83 which is insulated from the adjacent H plane wall and connected to inner conductor 50' of the coaxial difference port of the hybrid shown in FIGS. 6 through 8. The walls of section 78 are suitably connected to the outer conductor 52' of the coaxial difference port by attachment to the outside of the hybrid. Those skilled in the art will recognize that the transition section shown in FIG. 9 forms an end wall, coax to double ridge waveguide transition and may be arranged directly on the E plane wall 45' of the FIGS. 6 to 8 hybrid with any desired orientation of double ridge waveguide output 79.

While the invention has been described particularly with respect to ridge waveguide embodiments, wherein size and propagating mode limitations have prevented thus far the development of an E plane folded hybrid, those skilled in the art will recognize that the principles of the invention may be applied to other forms of waveguide, such as half-height rectangular waveguide, eliptical waveguide, or circular waveguide. The design of the coaxial difference port in accordance with the present invention greatly facilitates construction of a hybrid where the size of the junction region prevents the design of a hybrid in accordance with prior art. The invention may also be applied to standard waveguide hybrids where it is desired to have a coaxial difference port.

While there have been described what are believed to be the preferred embodiments of the present invention, those skilled in the art will recognize that other and further modifications may be had thereto without departing from the true spirit of the invention, and it is intended to cover all such embodiments which fall within the true scope of the invention.

I claim:

1. An E-plane folded hybrid comprising a double ridge waveguide, a first end of said waveguide forming an input port, an H-plane bifurcation extending partially into said waveguide from a second end, said bifurcation forming first and second single ridge waveguide colinear ports, each having an internal cross-section corresponding to half the cross-section of said double ridge waveguide, a coaxial difference port formed in the E-plane wall of said waveguide and having an outer conductor connected to said waveguide wall and an inner conductor connected to said bifurcation.

2. An E-plane folded hybrid as specified in claim 1 wherein said difference port is provided with a coaxial to ridge waveguide transition comprising a ridge waveguide section having a first ridge connected to the adjacent wall of said waveguide, and a second ridge insulated from the adjacent wall of said waveguide over a portion of said section, and connected to the center conductor of said difference port.

3. A hybrid in accordance with claim 1 wherein said inner conductor is connected to said bifurcation by an L shaped septum, which is substantially in the plane of said bifurcation.

4. An E-plane folded hybrid as specified in claim 3 wherein there are provided transverse ridges on the H-plane walls of said waveguide adjacent said L-shaped septum.

5. An E-plane folded hybrid as specified in claim 1 wherein said colinear ports are provided with tapered sections to transform said single ridge waveguide ports to double ridge waveguide ports.

6. An E-plane folded hybrid as specified in claim 5 wherein said input port is provided with a transformer thereby to provide a hybrid with identical input and colinear ports.

* * * * *